US005950411A

United States Patent [19]

Simon

[11] Patent Number: 5,950,411

[45] Date of Patent: Sep. 14, 1999

[54] DEVICE FOR TRANSMITTING SIGNALS OF A YARN MONITOR TO A CONTROL CIRCUIT OF A SPINNING LOCATION OF AN OPEN-END SPINNING MACHINE

[75] Inventor: Karsten Simon, Mönchengladbach, Germany

[73] Assignee: W. Schlafhorst AG & Co., Moenchengladbach, Germany

[21] Appl. No.: 08/994,783

[22] Filed: Dec. 19, 1997

[30] Foreign Application Priority Data

Sep. 11, 1996 [DE] Germany ..... 196 53 421

[51] Int. Cl.[6] ..... D01H 7/46

[52] U.S. Cl. ..... 57/264; 57/408; 57/412

[58] Field of Search ..... 57/264, 408, 265, 57/412

[56] References Cited

U.S. PATENT DOCUMENTS

| | | | |
|---|---|---|---|
| 4,056,926 | 11/1977 | Stuber | 57/264 |
| 4,195,345 | 3/1980 | Artzt et al. | 57/264 |
| 4,491,831 | 1/1985 | Sakai et al. | 57/265 |
| 4,716,718 | 1/1988 | Gobbels et al. | 57/263 |

FOREIGN PATENT DOCUMENTS

| | | | |
|---|---|---|---|
| 2 060 340 | 6/1972 | Germany . | |
| 2 123 641 | 11/1972 | Germany . | |
| 35 175 765 A1 | 11/1986 | Germany . | |
| 3628654 | 3/1988 | Germany | 57/264 |
| 91 00 145 | 6/1992 | Germany . | |
| 25 43 324 | 4/1996 | Germany . | |
| 405 764 | 7/1966 | Switzerland . | |
| 647 274 A5 | 1/1985 | Switzerland . | |
| 680 067 A5 | 6/1992 | Switzerland . | |

*Primary Examiner*—William Stryjewski
*Attorney, Agent, or Firm*—Kennedy Covington Lobdell & Hickman, LLP

[57] ABSTRACT

A device for transmitting yarn monitor signals to the control circuit of an open-end spinning station for determining whether a yarn spun by the spinning station is being drawn off or whether the yarn travel has been interrupted so that, in case of a yarn break, the infeed of the sliver into the spinning station is interrupted. Defects in electronic components in the circuit of the yarn monitor or in the sensor can result in a continuous yarn traveling signal to the control circuit of the spinning station despite a yarn break. The present invention therefore provides a receiver (5') for contactless receiving the yarn signal of the monitor and an oscillator (16) which can be actuated and deactuated based on the receiver output signal. An integrated circuit (22) is connected between the receiver and the oscillator (16) for generating and maintaining an actuating signal to the oscillator for generating oscillations thereby, and an alternating-voltage coupling (20) is connected between the oscillator and the control circuit of the spinning station for transmitting only an alternating voltage.

10 Claims, 1 Drawing Sheet

DEVICE FOR TRANSMITTING SIGNALS OF A YARN MONITOR TO A CONTROL CIRCUIT OF A SPINNING LOCATION OF AN OPEN-END SPINNING MACHINE

BACKGROUND OF THE INVENTION

The present invention relates to a device for transmitting yarn monitoring signals to the control circuit of a spinning station of an open-end spinning machine for determining actuation and deactuation of a sliver feeding device.

In open-end spinning machines, a yarn monitor determines whether a yarn spun by the spinning station is drawn off or whether the travel path of the yarn has been interrupted. If the yarn monitor determines that the spinning of the yarn has stopped, then the feeding of sliver at the spinning station is interrupted. However, problems in the circuit of a yarn monitor can cause the feeding device for the sliver to continue operation although a yarn break has occurred. Such an error can remain unnoticed for a rather long time if the sliver is removed via the suction conduit connected to the spinning chamber due to the prevailing spinning vacuum applied. However, there is also the possibility that the fibers collect in the spinning chamber and clog it. There is the further danger, especially in high-speed rotor spinning machines, that the fibers become heated and ultimately burn on account of the frictional heat.

German Patent Publication DE-OS 25 43 324 teaches an electric circuit arrangement for a yarn-break detecting element for textile machines, especially for fine spinning machines without spindles. A mechanical yarn feeler is utilized as a yarn-break detecting element. The attempt has already been made with the circuit disclosed in this publication to reduce the susceptibility to trouble of the control circuit, especially as concerns the possible failure of a transistor. The circuit therefore does not contain any transistors. However, the circuit is nevertheless not trouble-free since the contacts can remain stuck in the switch which is magnetically actuated upon a yarn break, as a result of which a signal flow indicating the presence of the traveling yarn path nevertheless remains preserved.

In electronic yarn monitors, a yarn traveling in a measuring slot of the yarn monitor generates a yarn traveling signal as the output of the sensor monitoring the yarn. This yarn traveling signal is transformed via switching amplifiers and fed as a direct-current signal to the control circuit of the spinning station. Upon failure of the yarn traveling signal, the drawing-in of the sliver is stopped.

FIG. 1 shows a simplified view of a block circuit diagram of the circuit of an electronic yarn monitor, explained in detail further below, as currently used in textile machines. A defect in an electronic component in the circuit of the yarn monitor or in the receiver itself, produced for example by an error in the voltage supply of the yarn monitor or by the sudden discharge of static electricity produced by the running yarn in the measuring slot, can cause the control circuit to fail to receive a yarn traveling signal at the spinning station or to constantly receive a yarn run signal even though no yarn is being spun any more, which is considerably more dangerous in its effect. If, for example, a short circuit between an emitter and a collector, i.e., a so-called transalloying, arises in the circuit transistor for the yarn traveling signal, the transistor can no longer be switched. The voltage signal then constantly assumes the value indicating continued traveling of the yarn, as a result of which fibers continue to be fed to the spinning station with the consequences indicated. Therefore, it must be absolutely assured that the infeed of fibers into the spinning chamber ceases if the yarn travel path is interrupted.

SUMMARY OF THE INVENTION

It is accordingly an object of the present invention to secure an open-end spinning station against problems and component errors in the transmitting of the signals by a yarn monitor to the control circuit of the spinning station so that the infeed of fibers is reliably avoided upon an interruption of the spinning process.

This object is basically achieved in a device for transmitting yarn monitoring signals to the control circuit of a spinning station of an open-end spinning machine for determining actuation and deactuation of a sliver feeding device, by providing a receiver for contactless receiving a yarn signal representing traveling movement of a yarn being spun and for producing an output signal based on the yarn signal, and an oscillator which is actuable according to the receiver output signal and is connected to the control circuit of the spinning station. An integrated circuit is connected between the receiver and the oscillator for generating and maintaining an actuating signal to the oscillator for generating oscillations thereby, and an alternating-voltage coupling is connected between the oscillator and the control circuit of the spinning station for transmitting only an alternating voltage.

If the yarn monitor is damaged, for example by an error in the supply voltage or the sudden discharge of static electricity, the design of the device in accordance with the present invention causes the oscillator integrated into the circuit to cease to generate any alternating voltage. Even if there would still be a direct voltage at the output of the yarn monitor or oscillator, a signal interruption would be present as a result of the subsequently actuated alternating voltage coupling on the control circuit of the spinning station so that the drive of the sliver feeding device would be immediately stopped. The danger of fire caused by overfeeding the rotor can be avoided in this manner.

The oscillator and the circuit for generating and maintaining its actuated signal can be housed with semiconductor circuits on commonly utilized substrate surfaces or chip surfaces. A fourfold operational amplifier can be utilized in this connection, for example, having two stabilized feedback inverse-coupled operational amplifiers for generating the actuated signal, i.e., for the signal evaluation of the receiver, and for the generation of oscillations in the oscillator. As a result, the common damage e.g. upon a voltage discharge is connected to the reliable sequence of the failure of the production of alternating voltage by the oscillator.

An especially simple form of alternating voltage coupling is constituted by a capacitor. Alternatively, for example, a transformer could be used.

In the present invention, even the use of an alternating voltage switching amplifier for the output of the oscillator does not involve the danger that a transalloying of the switching amplifier will result in maintaining the actuated signal for the fiber infeed since the alternating voltage coupling does not transmit the direct voltage signal which is then produced.

Since the control circuit is usually controlled by direct voltage signals, a rectifier should be connected in advance of the input of the control circuit due to the arriving alternating voltage signal.

In order to distinguish a yarn standing in the yarn monitor from a traveling yarn, it is advantageous to connect an alternating voltage coupling between the receiver of the yarn monitor and oscillator so that only the noise caused by the traveling yarn is transmitted. The use of an electric filter in the circuit for actuating and deactuating the oscillator can be necessary, particularly if noise sources are present in the area of the yarn monitor which generate a noise signal in the yarn monitor independently of the yarn, such as gas discharge lamps by way of example. Moreover, it is advantageous to set a threshold value for the noise signal at a level which is exceeded only if the yarn is actually moving in the measuring slot.

DESCRIPTION OF THE PREFERRED EMBODIMENT

Figure 1:
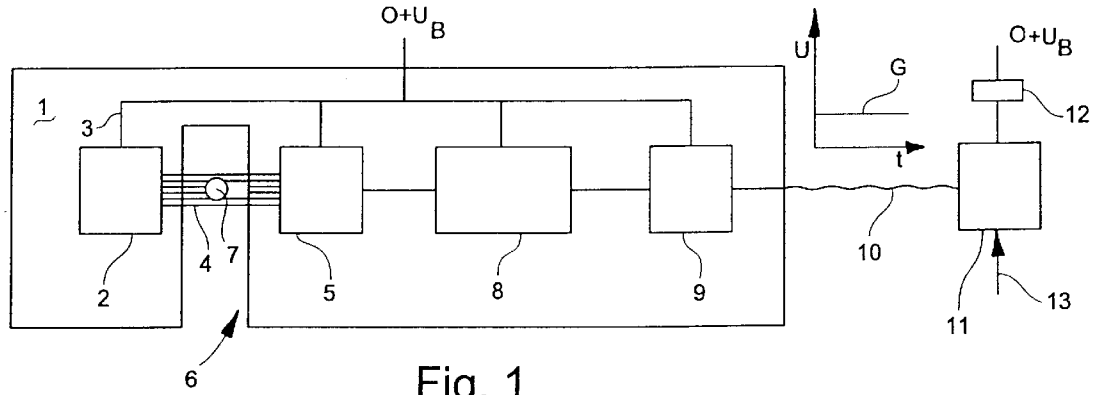
Fig. 1 (Prior Art)
FIG. 1 is a block diagram showing a conventional circuit for signal formation and signal transfer in a yarn monitor utilized in an open-end spinning machine.

Referring now to the accompanying drawings and initially to FIG. 1, a block circuit diagram is shown representing a known conventional form of yarn monitor, designated as a whole by 1. In this exemplary embodiment, the yarn monitor basically consists of an optical yarn sensor as well as the electronic components required for signal amplification and evaluation. The yarn monitor can also be equipped with a capacitive sensor. The yarn monitor can be completely installed in and removed from the spinning station. A light transmitter 2, e.g. an infrared transmitting diode, is arranged in the yarn monitor 1, and is connected to current supply 3 of yarn monitor 1. Transmitting diode 2 emits a constant infrared light flux 4 which is directed onto receiver 5. Yarn 7 to be checked travels within light flux 4 through measuring slot 6. The movement of yarn 7 and its cross section, which is constantly changing over its length, cause a shadowing of receiver 5 with a constantly changing intensity.

Receiver 5 consists of a phototransistor which is connected to a circuit 8 for signal amplification and evaluation. In the case that yarn is absent from or standing stationary in measuring slot 6, e.g. after a yarn break, the shadowing of phototransistor 5 does not change in intensity, so that a direct current flows. In circuit 8, a capacitor is connected after the transistor and forms a barrier for a direct current signal. When the yarn is traveling, a yarn noise signal is produced as a voltage with constantly changing amplitude. Circuit 8 for signal amplification and evaluation transmits a signal when the yarn is running. A customary supply direct voltage, e.g. 24 volts, is actuated with this yarn running signal via switching amplifier 9, which may be a transistor amplifier. This direct voltage signal G is applied to control circuit 11 of a spinning station via lead 10. Disturbances, e.g., noise, can also occur in the area of lead 10, e.g. by damage or defective contacts at the connection positions, such as may be caused by contact corrosion.

Coupling 12 of the sliver supply is maintained in an actuated state by control circuit 11 due to the presence of direct voltage signal G. Coupling 12 is opened only upon the absence of signal G. In the embodiment depicted, a magnetic coupling is used for coupling the feeding roller to its drive. The sliver is fed into the spinning station with the feeding roller.

It will be understood from the above that, whenever a disturbance occurs which maintains a current flux or flow in lead 10, e.g. upon a transalloying of the transistor of switching amplifier 9, the coupling can not be opened and, as a result, the fiber infeed can not be interrupted.

Direct voltage signal G in lead 10 is also used in control circuit 11 to determine production data, e.g. to determine the spooled-up yarn length, which in turn is used to deactuate the sliver supply when the length of spun yarn attains a pre-set value. The linking of the yarn traveling signal to other data is indicated by arrow 13. A signal which is then present can likewise be delivered to coupling 12 in order to interrupt the supply of sliver, if necessary. Furthermore, the lifting of the cross-wound bobbin off of the winding roller can be initiated with the signal.

Figure 2:
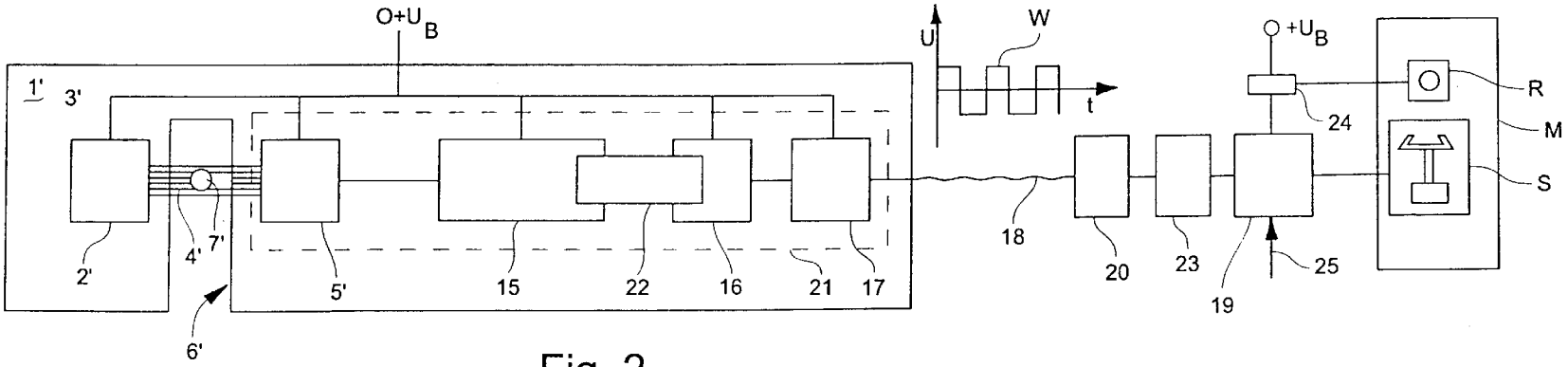
FIG. 2 is a similar block circuit diagram representing a control circuit in accordance with the present invention.

FIG. 2 is a block circuit diagram of the control circuit in accordance with the present invention. In this embodiment, the yarn monitor also consists of a replaceable structural unit 1' comprising the electronic components necessary for signal amplification and evaluation, and particularly has in common with the yarn monitor of FIG. 1 a light transmitter 2' and a receiver 5'. A capacitive sensor can also be provided. The monitoring of traveling yarn 7' in measuring slot 6' also takes place in this embodiment by the evaluation of infrared light flux 4' which is directed at receiver 5' and is attenuated by yarn 7'.

The evaluation of the signals of receiver 5' and the transmission of the yarn traveling signal to the control circuit of the spinning station takes place with a circuit comprised as follows. Circuit 15 for signal amplification and evaluation is connected with receiver 5' and generates the yarn traveling signal. Circuit 15 comprises an electric filter which filters out interfering frequencies of external noise sources which may simulate a yarn noise signal in the case of a standing or absent yarn through a frequency course similar to the yarn traveling signal. Possible noise sources are e.g. gas discharge lamps. The filtering out of the interfering frequencies assures that only the actual yarn noise signal is evaluated.

Moreover, a threshold switch is integrated in circuit 15 for signal amplification and evaluation which switch makes possible the transmission of a yarn traveling signal only if the yarn noise signal has exceeded a certain threshold, i.e., a noise level at or above which the yarn is moving at a sufficient speed to indicate that normal drawing off of the yarn during a spinning procedure is occurring and thereby justifies an infeed of sliver.

As in the circuit of FIG. 1, the circuit of the present invention operates in the case of an absent or standing yarn to block or prevent the direct current signal of receiver 5' by means of an alternating voltage coupling, e.g. by a capacitor, in signal amplification and evaluation circuit 15.

Oscillator 16 is an essential component of the circuit of the yarn monitor in the present invention. Oscillator 16 should only generate an alternating voltage if a signal is present from signal amplification and evaluation circuit 15 indicating that the yarn is running. The oscillator is followed in the present exemplary embodiment by alternating-voltage switching amplifier 17 which switches a supply voltage, e.g., of 24 volts, via lead 18 to control circuit 19 of the spinning station. A switching amplifier is always advantageous if the signals must be transmitted over leads extending any considerable spatial distance. The output signal of alternating-voltage switching amplifier 17 controlled by the oscillator is alternating-voltage signal W.

This alternating-voltage signal W is supplied to alternating-voltage coupling 20 which is connected in advance of control circuit 19 of the spinning station S of open-end spinning machine M and which is also essential for the invention. Alternating-voltage coupling 20 may consist of a capacitor or transformer. If, for example, an error in alternating-voltage amplifier 17 would result in a direct-voltage signal, the input signal on control circuit 19 would be interrupted since the direct-voltage signal can not pass alternating-voltage coupling 20. A direct-voltage signal therefore has the same effect as a signal that the yarn is absent or stationary.

As a result of the possible appearance of errors in components connected in advance of oscillator 16, it is possible that a voltage may be presented to the oscillator which mimics a yarn traveling signal although no yarn is present or running. In such an instance, oscillator 16 would continue to supply an alternating-voltage signal as a yarn traveling signal. In order to prevent this occurrence, however, the present invention is designed as a precaution that, in the case of damage occurring to or the destruction of a component in advance of oscillator 16, the oscillator is also damaged such that it either supplies no signal or only a direct-voltage signal. In both instances, this would result in an interruption of the yarn traveling signal and thereby would result in a separation of the coupling on the feeding roller so that the feeding of sliver would be stopped.

If the oscillator and the signal amplification and evaluation circuit which generates the yarn traveling signal are housed on a common substrate surface or chip surface, damage in one component will entail the damaging of all circuits on the substrate. In the present exemplary embodiment, receiver 5', signal amplification and evaluation circuit 15 which generates the yarn traveling signal, oscillator 16 and alternating-voltage switching amplifier 17 are supported on common substrate surface 21 indicated by the dotted frame in FIG. 2. In the present exemplary embodiment, two stabilized-feedback operational amplifiers of fourfold operational amplifier 22 serve for the signal evaluation of receiver 5' and to generate the yarn traveling signal as an actuation signal to oscillator 16 and two other stabilized-feedback operational amplifiers of the fourfold operational amplifier serve to generate oscillations in oscillator 16. A voltage discharge or other form of damage results in a destruction of fourfold operational amplifier 22 and therewith in a reliable failure of the generation of alternating voltage by oscillator 16. Even if a direct voltage is still present beyond oscillator 16 it is not transmitted through alternating-voltage coupling 20.

The design of the circuit of the yarn monitor in accordance with the present invention assures that in the case of any conceivable damage to the circuit no signal reaches control circuit 19 of the spinning station which would make possible an inadmissible feeding of sliver.

Since only a direct voltage can be used in control circuit 19 of the spinning station in the present exemplary embodiment, rectifier 23 is connected in after alternating-voltage coupling 20. As a result thereof a direct-voltage input signal is delivered to control circuit 19 of the spinning station. Coupling 24 is coupled to the sliver feeding roller R via control circuit 19 in accordance with the exemplary embodiment of FIG. 1 only when the yarn is running. If the feeding roller is driven by a single drive, not shown, the yarn traveling signal can also act on the circuit of such drive.

As in the circuit of FIG. 1, the yarn traveling signal produced by the control circuit of the present invention according to FIG. 2 can also be used to determine production data or be linked to other signals, as indicated by arrow 25. The signal which is then produced can also act on the coupling at the feeding roller, e.g. when the winding bobbin has reached its a predetermined fullness.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed:

1. A device for transmitting yarn monitoring signals to a control circuit of a spinning station of an open-end spinning machine for determining actuation and deactuation of a sliver feeding device, comprising a receiver for contactless receiving a yarn signal representing traveling movement of a yarn being spun and for producing an output signal based on the yarn signal, an oscillator actuable according to the receiver output signal, an integrated circuit connecting the receiver and the oscillator for generating oscillations thereby, and an alternating-voltage coupling between the oscillator and the control circuit of the spinning station for transmitting only an alternating voltage to the control circuit.

2. The device according to claim 1, wherein the alternating-voltage coupling comprises a capacitor or a transformer.

3. The device according to claim 1, further comprising an alternating-voltage switching amplifier connected to the output of the oscillator for feeding a signal to the alternating-voltage coupling.

4. The device according to claim 1, further comprising a rectifier connected between the alternating-voltage coupling and the control circuit for generating a direct-voltage input signal to the control circuit.

5. The device according to claim 1, wherein the oscillator is adapted to generate an alternating voltage with constant amplitude.

6. The device according to claim 1, further comprising a circuit connected between the receiver and the oscillator and comprising an alternating-voltage coupling for transmitting substantially only a noise signal produced by the normal traveling motion of the yarn.

7. The device according to claim 6, wherein the noise signal circuit generates the signal for actuating and deactuating the oscillator and comprises an electric filter following the receiver for filtering the noise signal.

8. The device according to claim 6, wherein the noise signal circuit comprises means for monitoring whether a threshold value of the noise signal is exceeded and for generation of a direct-voltage signal when the threshold value is exceeded.

9. The device according to claim 1, wherein the integrated circuit comprises means for generating vibration of the oscillator.

10. The device according to claim 9, wherein the receiver, the oscillator, the integrated circuit, and the alternating-voltage coupling are supported on a common substrate, whereby damage to any one thereof will disable correct operation of the device.

* * * * *